US005385261A

United States Patent [19]

Lippisch et al.

[11] Patent Number: 5,385,261

[45] Date of Patent: Jan. 31, 1995

[54] DISH DRAINER

[75] Inventors: Hangwind F. Lippisch, Fitchburg; Cory J. Kruger, Winchendon, both of Mass.

[73] Assignee: Sterilite Corporation, Townsend, Mass.

[21] Appl. No.: 724,705

[22] Filed: Jul. 2, 1991

[51] Int. Cl.[6] ..... B65D 21/00

[52] U.S. Cl. ..... 220/572; 220/23.83

[58] Field of Search ..... 220/572, 23.83, 23.86, 220/487

[56] References Cited

U.S. PATENT DOCUMENTS

| | | | |
|---|---|---|---|
| 986,265 | 3/1911 | Boss | 220/23.83 X |
| 1,252,220 | 1/1918 | Benson | 220/572 X |
| 1,997,529 | 4/1935 | Miller | 220/572 X |
| 3,027,041 | 3/1962 | Stansbury, Jr. et al. | 220/572 |
| 3,442,395 | 5/1969 | Taylor | 220/572 X |
| 4,572,368 | 2/1986 | Miller et al. | 220/23.86 X |

OTHER PUBLICATIONS

Focus on Value, Rubbermaid, pp. 2 and 24 and 25.
Transco Housewares, Sinkware.
Curver, Kunststoff in Bestform, 1991.
Rubbermaid, 1991.
Tucker Housewares, prior to Jul. 2, 1991.
Sterilite ® sell sheets prior to Jul. 2, 1991.
FREM, 1991.

*Primary Examiner*—Steven M. Pollard
*Attorney, Agent, or Firm*—Donald Brown

[57] ABSTRACT

This invention is directed to dish drainers, which have integrally formed connecting elements in the basket and pan thereof.

The connector elements are used to maintain the basket and pan coupled together during shipment, when displayed for sale or when in use. The connector may be disconnected to separate the pan from the basket in order to clean the dish drainer components.

3 Claims, 7 Drawing Sheets

DISH DRAINER

BACKGROUND OF THE INVENTION

This invention is directed to a new and improved dish drainer. Dish drainers are widely used in the kitchen to permit washed dishes, glasses, cups and utensils to drip dry after washing.

Dish drainers comprise two separate units, the upper being called the basket (rack) and the bottom being called the pan. The basket normally sits on the pan, which catches the water from the washed dishes, etc., and directs the water into the adjacent sink.

In shipping the dish drainers, it is today commonplace that they are placed in packaging in an attempt to hold the basket and rack together for future sale. In most instances, a plastic shrink wrapping and a corrugated board are used for this purpose. This constitutes additional, non functional components that add to the cost of the product and present a problem in recycling due to the type of plastic film and cardboard required. Todays environmental concerns are focused on reducing or eliminating all difficult to recycle packaging. If the basket and rack are not held together properly, they will separate when displayed for sale, causing product rejection.

Users also find that the basket, particularly when not loaded with dishes will move on the pan. When the pan and basket are tilted to drain off excess water into the sink, an unsecured basket will slide forward and in some cases, will slide into the sink.

The present invention provides a solution to the aforementioned disadvantages noted above.

BRIEF DESCRIPTION OF THE INVENTION

The present invention provides a new and improved two part dish drainer comprising a basket (rack) and a drain pan, which can be interconnected for shipping or in use, and which also can be separated for cleaning. In order to accomplish the aforementioned, the pan preferably includes a plurality of flexible straps integral with the pan. The straps each include a connector which fits into an opening (receptacle) formed in the basket until such time as the strap is disconnected from the receptacle by the user to separate the basket from the pan.

Total elimination of packaging has thus, been achieved for both better cost efficiency and elimination of recycling problems.

DETAILED DESCRIPTION OF THE INVENTION

Figure 1:
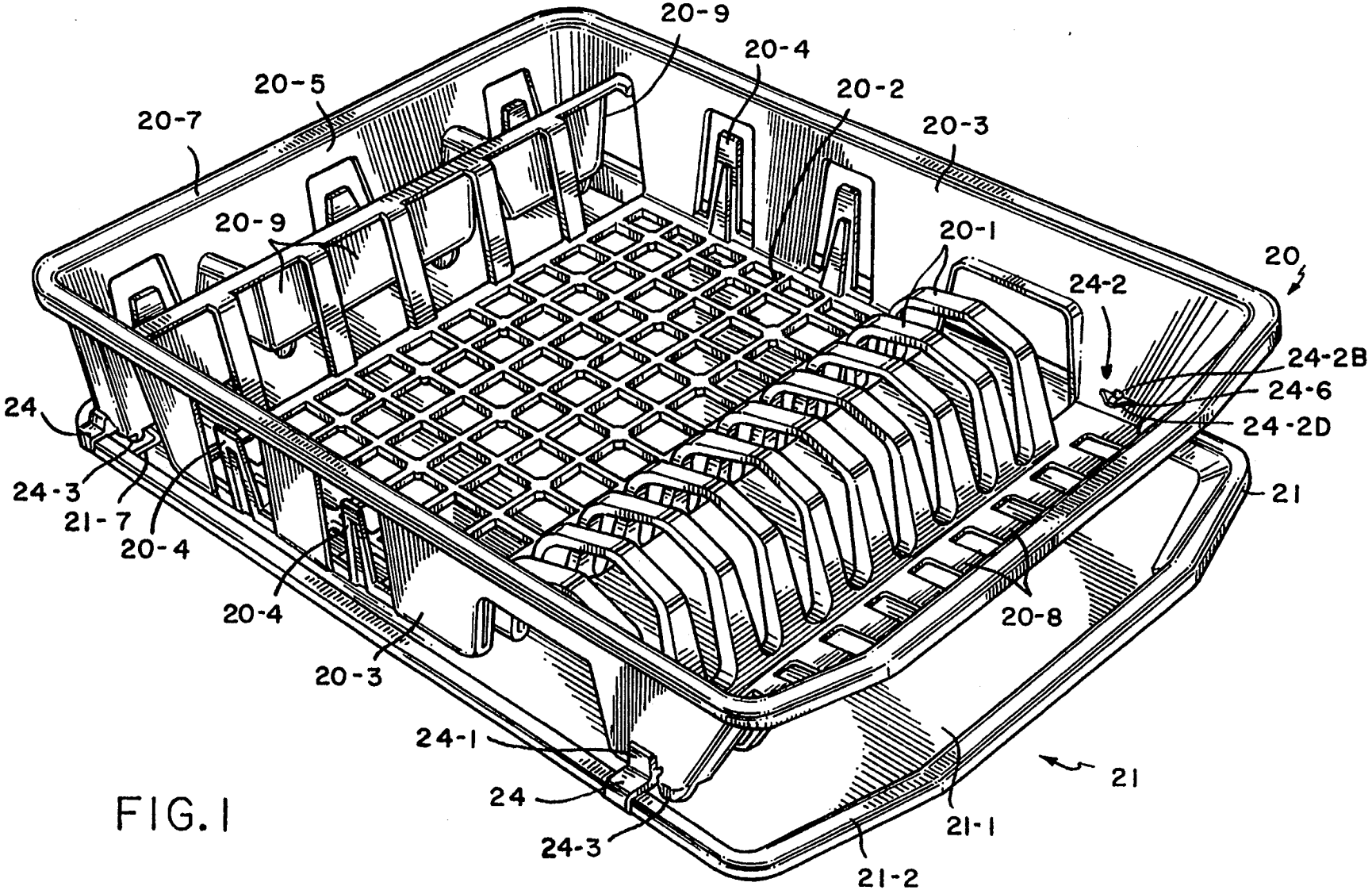
FIG. 1 is a perspective view of the dish drainer of the invention showing the basket coupled to the pan.
Figure 2:
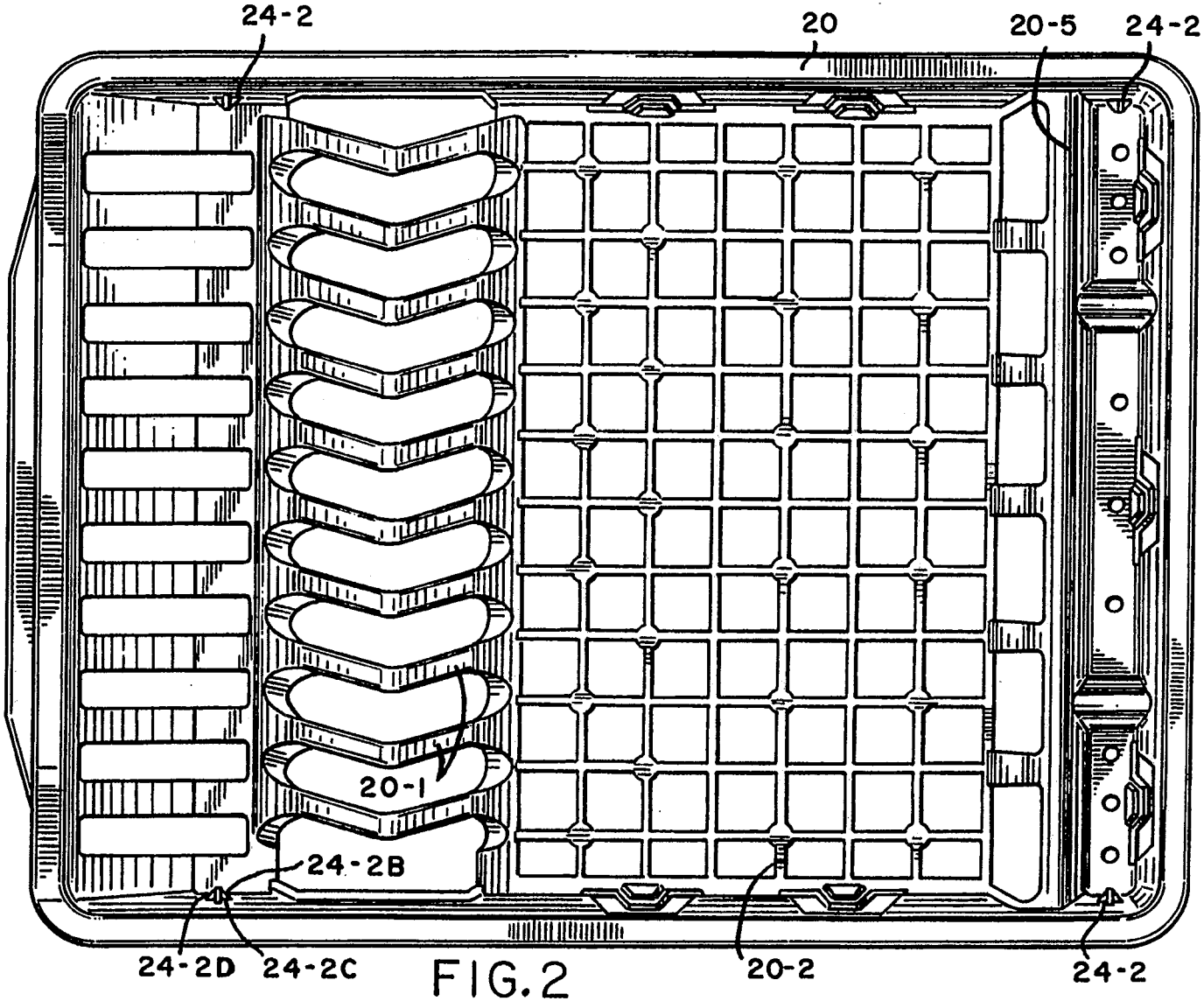
FIG. 2 is the top plan view of the dish drainer.
Figure 3:
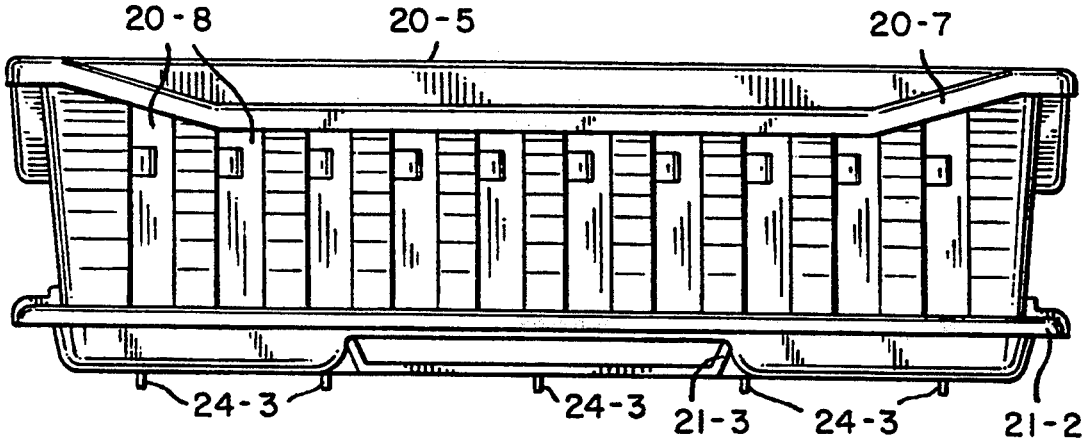
FIG. 3 is an end view of the dish drainer for placement adjacent to the sink.
Figure 4:
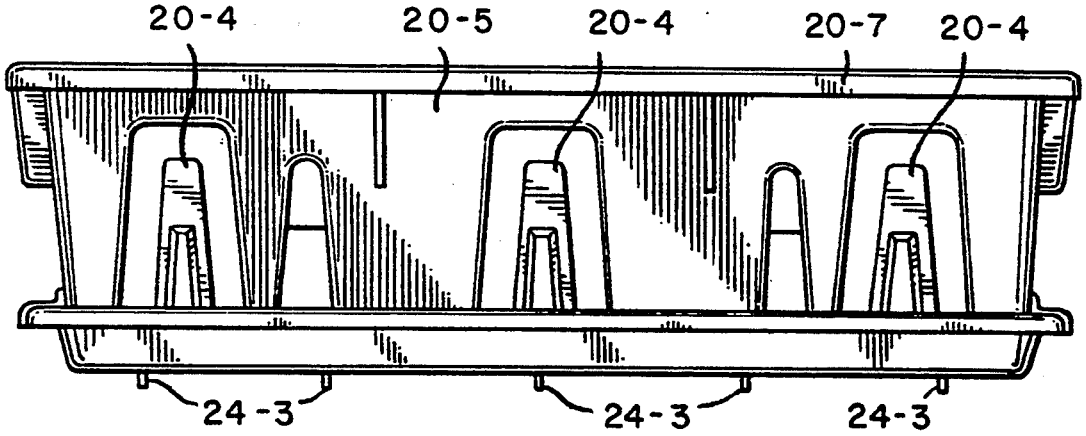
FIG. 4 is an opposite end view of the dish drainer.
Figure 5:
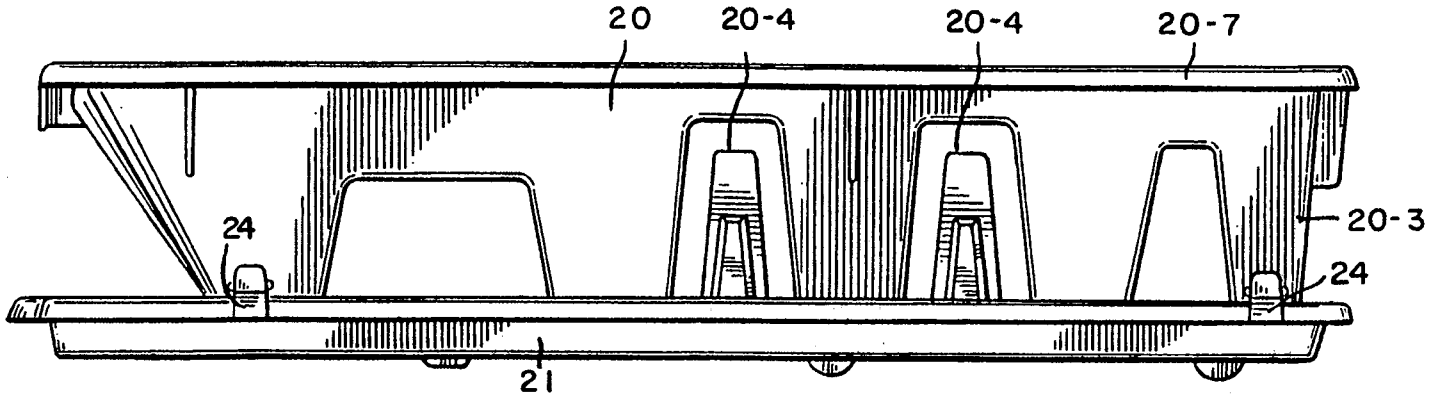
FIG. 5 is a side view of the dish drainer of the invention, one side being a mirror image of the other side.
Figure 9:
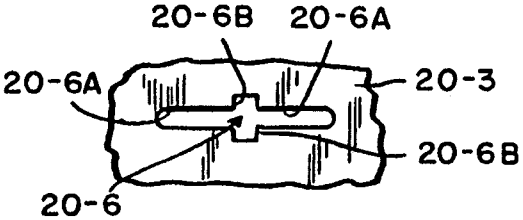
FIG. 9 is an enlarged view of a portion of the basket showing the opening (receptacle) for receiving a portion of the strap tip.
Figure 8:
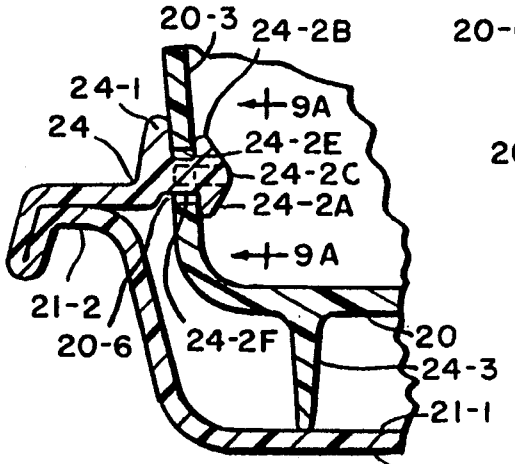
FIG. 8 is a sectional view taken along lines 8—8 in FIG. 7.
Figure 7:
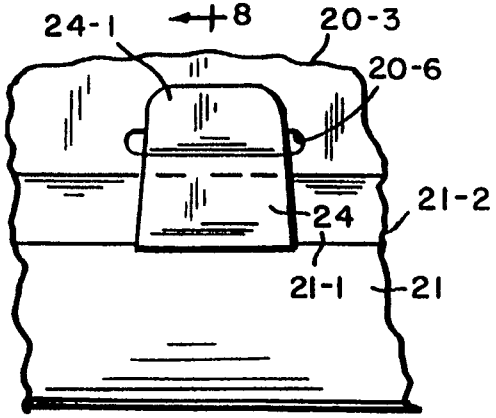
FIG. 7 is an enlarged view of the strap being used to interconnect the pan with the basket.
Figure 6:
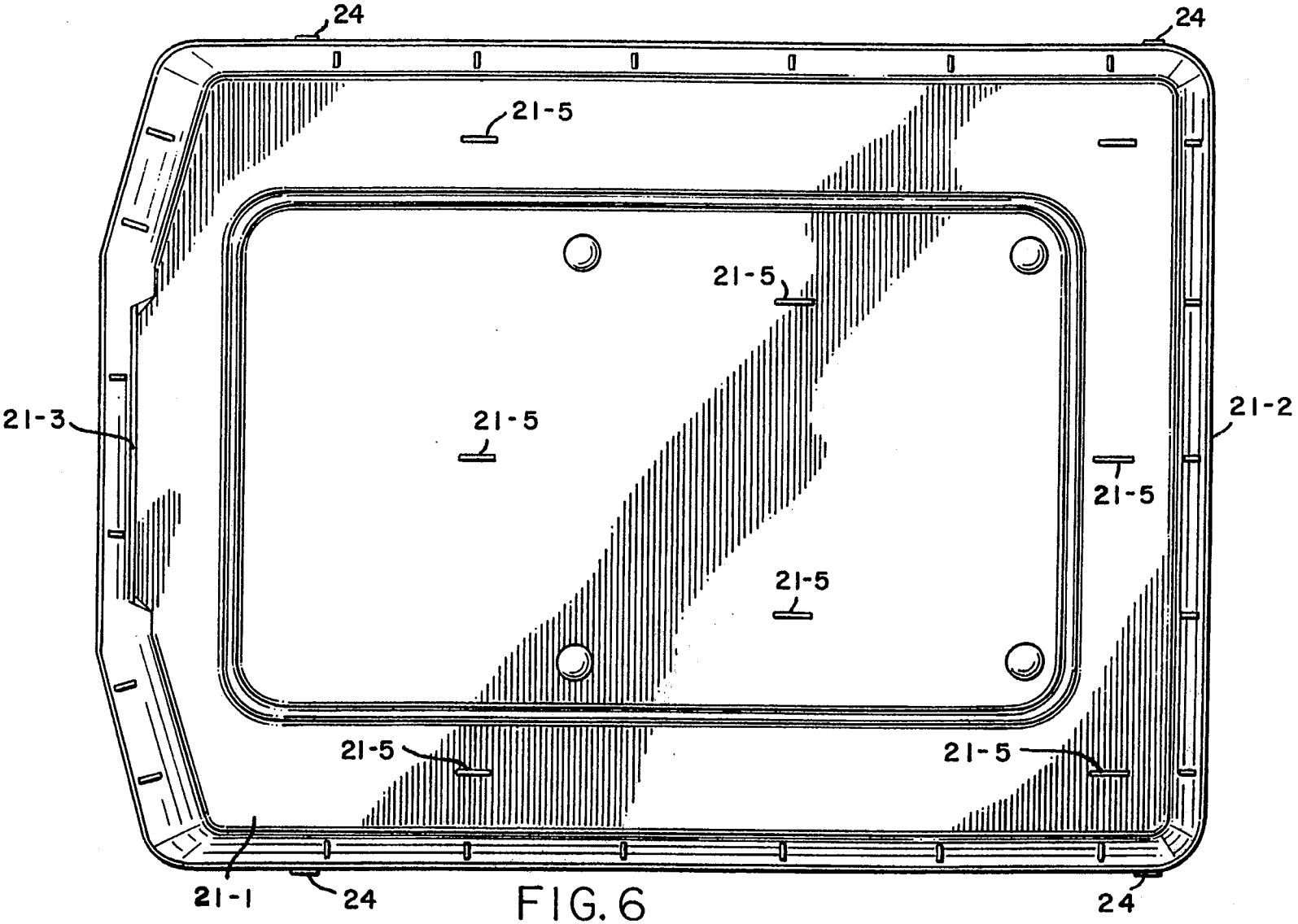
FIG. 6 is a bottom plan view of the pan.
Figure 10:
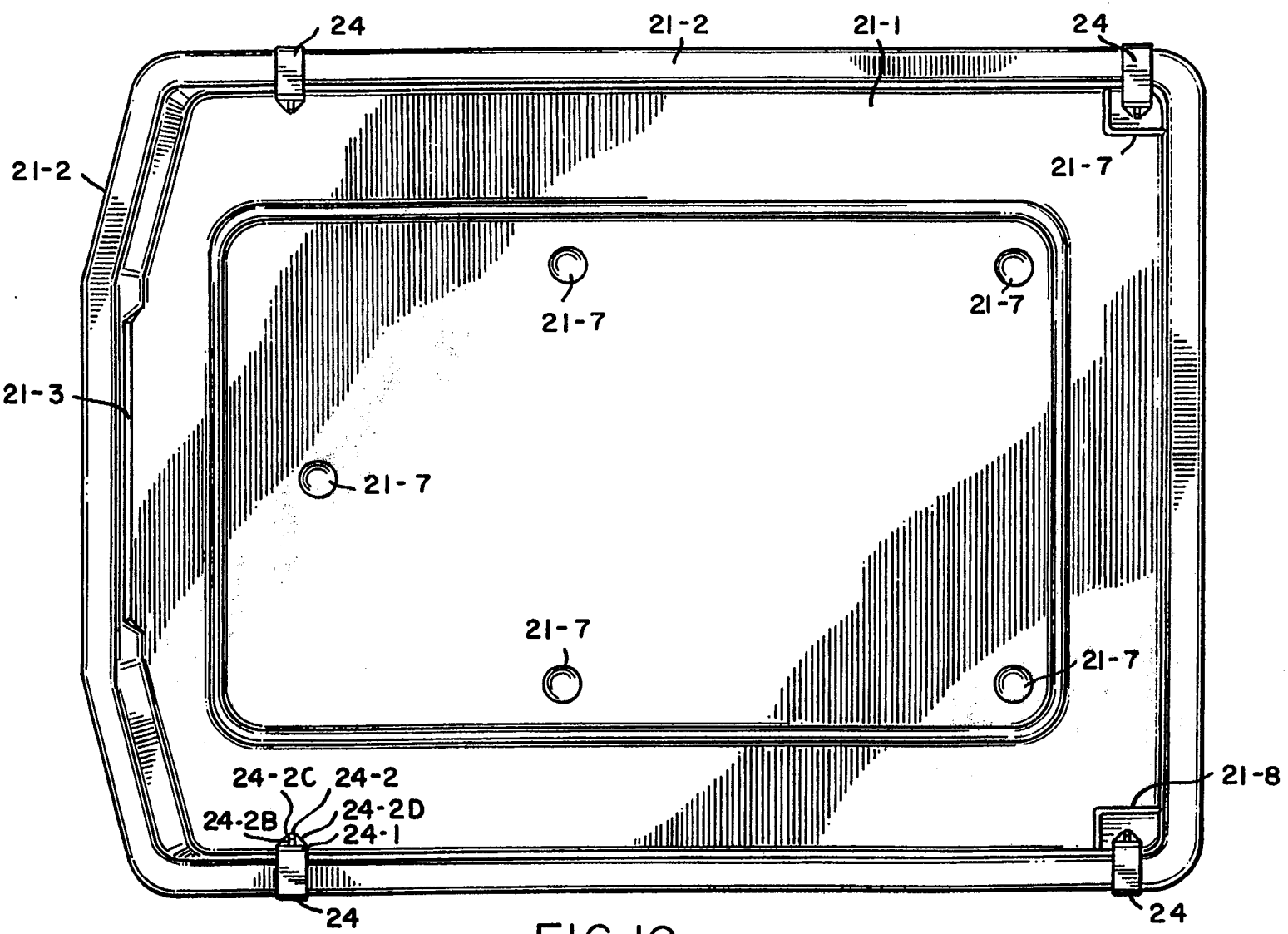
FIG. 10 is a top plan view of the pan.
Figure 11:
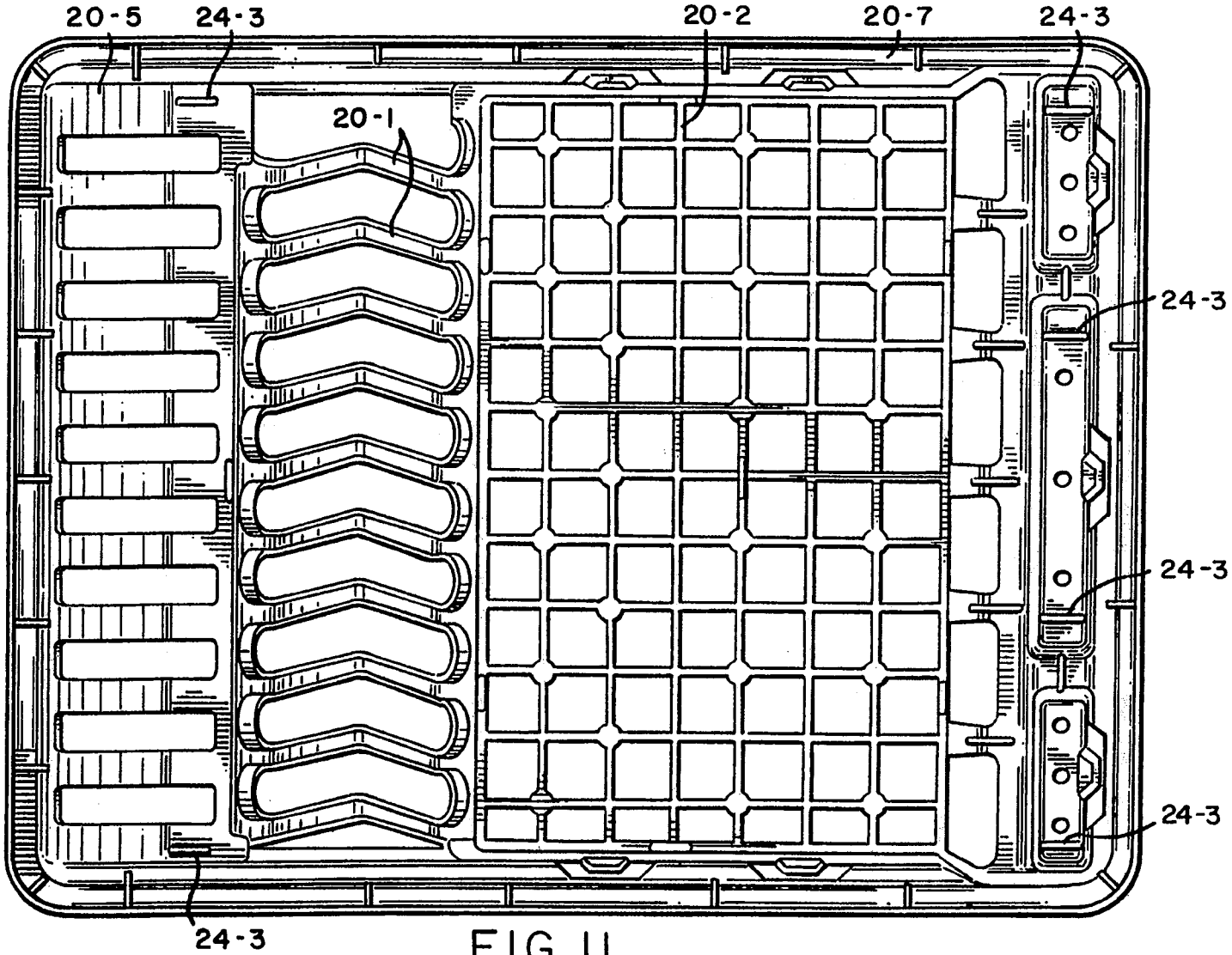
FIG. 11 is a bottom plan view of the basket.

Reference should now be had to FIGS. 1 through 11 for a detailed description of the invention.

At 21 there is shown a basket (rack) for holding dishes, approximately upright, at an inclination of up to 15° between ribs 20-1. For holding cups, etc., a central open ribbed tray portion 20-2 is provided. Silverware and other utensils are held in sections (compartments) 20-9. The basket includes side walls 20-3, and a rear wall 20-5 with prongs to hold cups and glasses. A front ribbed wall 20-8 affords additional air circulation onto dishes. The rim 20-7 is contoured along the front face of the basket to accommodate even stacking of units (basket attached to pan) at point of sale.

Vertical projecting members (prongs) 20-4 are provided to hold glasses and cups. Legs 24-3 are provided on the underside thereof. Water on the stored wet dishes, etc., is able to drip through openings between the ribs and in the compartments 20-9 onto a pan 21 on which the basket 20 is placed.

The pan is shown at 21 and includes a bottom 21-1, a rim 21-2, and an opening 21-3 for water to flow out of the pan and into a sink adjacent to it.

Normally in use, the pan opening 21 overhangs a portion of a sink. The pan 21 includes a plurality of straps 24 formed integral therewith (extending from and coupled to the rim 21-2) for holding the basket on the pan.

The straps 24 includes a connecting point 24-2, which may be urged into opening (receptacle) 20-6 in the side walls 20-3 by pushing on tab 24-1. The opening 20-6 comprises a horizontal wider opening 20-6A and a crossing smaller vertical opening 20-6B (See FIG. 9).

Figure 9A:
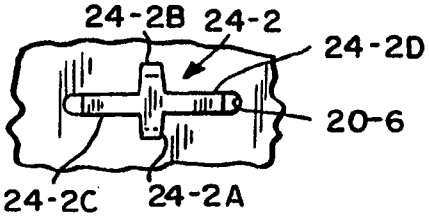
FIG. 9A is a view similar to FIG. 9 with the strap arrow like point positioned in the opening of FIG. 9.

The point 24-2 of the strap 24 is in the shape of an arrow tip having horizontal inclined portions (planes) 24-2C and 24-2D (See FIGS. 1, 2, 9A and 10), and vertical inclined portions (planes) 24-2A and 24-2B (See FIGS. 1, 2, 8, 9A and 10). To the rear of the portions 24-2A and 24-2B are valley portions 24-2E and 24-2F in which the side wall 20-3 is positioned after a portion of the tip is forced through the opening and into position shown at FIGS. 7, 8, 9 and 9A).

The height of the vertical inclined portions 24 (arrow portion) are greater than the height of the vertical opening 20-6B, so that after the arrow portions 24-2A and 24-2B are forced into the opening 20-6 by sideways force (See FIGS. 8 and 9A), the side wall 20-3 is positioned between the tab 24-1 and the rear of the arrow portions 24-2A and 24-2B in the cutouts (valleys) 24-2E and 24-2F.

To separate the pan from the basket, the tabs are used again to pull the arrow portion through the same flexible plastic side wall openings 20-6.

The pan depressions 21-7 and the boundary ribs 21-8 in the pan (See FIG. 10) are for receiving basket feet 24-3 in order to help position the basket on the pan.

The dish drainer pan and basket may be preferably made from polypropylene, however, other plastic materials such as ABS and high strength types of plastic may also be used. The dish drainer is preferably made using conventional injection molding technology.

It is also to be appreciated that alternatively and less preferably the straps may be formed as an integral part of the basket and be positioned in an opening (receptacle) in the pan if desired. It should also be realized that different types of connectors in place of the arrow type and receptacle described, could also be used if desired, however, the connecting system disclosed in the drawing is most preferred because of its simplicity in manufacture and in use.

We claim:

1. A dish drainer comprising a plastic basket and a plastic pan, a plurality of first strap means integral with and a part of said pan for connecting said pan to said basket, said basket having a plurality of receptacle means for connecting to said first strap means, wherein said basket is coupled to said pan by said first strap means coupled to said receptacles, and in which said pan has a rim and in which each of said first strap means extends from said rim and is of the same plastic material as the pan.

2. A dish drainer comprising a plastic pan having two sides and having a plurality of straps integral therewith and of the same material and extending from both of the sides thereof, each of said straps having an end member retained in a different receptacle opening of a basket, said end member comprises a tip and an inclined plane which extends rearward from said tip, said inclined plane ending in a rear wall, said tip extending into said receptacle opening a sufficient distance whereby said rear wall retains said tip in said opening.

3. A dish drainer comprising a plastic drain pan an a plastic dish basket, said drain pan having two sides, and said drain pan having a plurality of plastic straps rotably coupled to each side of said drain pan and integral with said drain pan, each of said straps having connector means at the free end thereof, said dish basket positioned on and between said sides of said drain pan and having plurality of connector receiving receptacle means for locking each of said plurality of connector means therein, said connector means positioned and locked in a different one of said plurality of connector receiving receptacle means to limit the movement of said dish basket on said drain pan.

* * * * *